US006409294B1

(12) United States Patent
Zimmermann et al.

(10) Patent No.: US 6,409,294 B1
(45) Date of Patent: Jun. 25, 2002

(54) DIGITAL POSTAGE FRANKING WITH COHERENT LIGHT VELOCIMETRY

(75) Inventors: Eric Zimmermann, La Neuveville; Christian Moy, Grossaffoltern, both of (CH)

(73) Assignee: Ascom Hasler Mailing Systems AG, Bern (CH)

( * ) Notice: Subject to any disclaimer, the term of this patent is extended or adjusted under 35 U.S.C. 154(b) by 0 days.

(21) Appl. No.: 09/573,646

(22) Filed: May 18, 2000

Related U.S. Application Data

(63) Continuation of application No. 09/023,457, filed on Feb. 13, 1998.
(60) Provisional application No. 60/068,434, filed on Dec. 22, 1997.

(51) Int. Cl.[7] ..... B41J 3/00
(52) U.S. Cl. ..... 347/2
(58) Field of Search ..... 347/2, 19, 14, 347/23, 16; 356/28.5; 73/1.41; 705/408

(56) References Cited

U.S. PATENT DOCUMENTS

| | | | | |
|---|---|---|---|---|
| 4,074,279 A | | 2/1978 | Ikeda et al. | 347/4 |
| 4,794,384 A | | 12/1988 | Jackson | 340/710 |
| 4,875,769 A | | 10/1989 | Linebarger | |
| 4,990,791 A | | 2/1991 | Nishi | 250/561 |
| 5,589,858 A | * | 12/1996 | Kadowaki et al. | 347/14 |
| 5,883,731 A | * | 3/1999 | Kasai | 359/204 |
| 5,884,293 A | * | 3/1999 | Herbert | 705/408 |

FOREIGN PATENT DOCUMENTS

| | | |
|---|---|---|
| EP | 0328781 | 8/1989 |
| EP | 0461437 | 12/1991 |
| EP | 0718799 | 6/1996 |
| WO | WO 86/06845 | 11/1986 |

OTHER PUBLICATIONS

Mumnasja, Noncontact Speed & Length Measurement, www.polytec.com, pp. 6, Nov. 22, 1999.*

(List continued on next page.)

*Primary Examiner*—John Barlow
*Assistant Examiner*—Charles W. Stewart, Jr.
(74) *Attorney, Agent, or Firm*—Perman & Green, LLP

(57) ABSTRACT

A postage meter (franking machine) uses a digital print head such as an ink-jet or thermal transfer or dot-matrix print head, for which it is necessary to know the velocity of the mail piece passing by the print head. Two collimated monochromatic beams strike the mail piece, one at an angle leading the mail piece velocity and the other at an angle lagging the mail piece velocity. The beams converge yielding a sensing region filled with a diffraction pattern. The mail piece, assumed to be rough at a scale that is appropriate for the velocity measurement, moves at some velocity. A detector detects light intensity (photon flux) at a small region within the sensing region, and the intensity signal has a frequency that is proportional to the mail piece velocity. The frequency is detected or measured, the instantaneous velocity is derived therefrom, and the velocity is used to control the print head. In this way a two-dimensional print image (postage indicium) is faithfully printed on the mail piece with minimal distortion even in the event of non-constant velocity of the mail piece.

20 Claims, 7 Drawing Sheets

OTHER PUBLICATIONS (M0H1Q9FM.HTM) Mumnasja, Noncontact Speed & Length Measurement, www.polytec.com, Nov. 22, 1999, 6 pages.*

Schnell, U., et al., "Detection of movement with laser speckle patterns: Statistal properties", J. Optical Society of America, 15:207–216, Jan. 1998.

"Interferometric displacement measurement on scattering surfaces utilizing speckle effect" by Leedertz, Journel of Physics E: Scientific Instruments, 3, pp 214–218 (1970).

"Measuring microvibrations by heterodyne speckle interferometry", by Dandliker and Willemin, Opt. Lett., 6, pp 165–167 (1981).

"Theory and applications of dynamic laser speckles due to in–plane object motion", by Yamaguchi and Komatsu, Opt. Acta, 24, pp 705–724 (1977).

"Velocity measurement of a diffuse object by using time–varying speckles", by Ohtsubo and Asakura, Opt. Quant. Elec., 8, pp 523–529 (1976).

"Real–time velocity measurement for a diffuse object using zero–crossings of laser speckle", by Takai, Iwai and Asakura, J. Opt. Soc. Am., 70, pp 450–455 (1980).

"Non–Contact Velocity, and Length–Measurement of Paper Using The Cross–Correlation Technique With Optical Sensors", by Ziesemer, Instrumentation and Automation in the Paper, Rubber, Plastics and Polymerization Industries, Pergamon press, pp 51–56 (1983).

"Correlation in instruments: cross correlation flowmetes", by Beck, Journal Phys. E: Sci. Instrum., 14, pp 7–19 (1981).

"A Speckle Pattern Velocimeter Using a Periodical Differential Detector", by Ogiwara and Ukita, Jpn. App. Phys. Suppl., 14, pp 307–310 (1975).

"Jet Speed Measurement of Correlation of Optical Signals", by Bolon, Moisan and Sabater, Instrumentation and Automation in the Paper, Rubber, Plastics and Polymerization Industries, Pergamon press, pp 43–50 (1983).

* cited by examiner

DIGITAL POSTAGE FRANKING WITH COHERENT LIGHT VELOCIMETRY

This application is a continuation of Ser. No. 09/023,457, filed Feb. 13, 1998, which claims benefit of Provisional Appln. 60/068,434 filed Dec. 22, 1997.

The invention relates generally to the printing of digital postal indicia, and relates in particular to approaches for the non-contact measurement of velocity of a mail piece using interference patterns created by beams of coherent light.

BACKGROUND

For many decades it has been routine to print postal indicia by means of relief printing dies. By "relief dies" is meant dies in which the high points receive ink which is transferred to a mail piece. This is contrasted to intaglio print elements in which ink is applied to the entirety of the printing plate and removed from the high points, leaving ink only in the low points to be transferred to the paper. The relief printing die offers many advantages, among them that the image quality is very good due to the pressure applied by the die upon the mail piece, which tends to keep the mail piece captive and reduce the possibility of unwanted and unintended motion of the mail piece relative to the printing die. A person who might attempt to print postal indicia without paying for them would be faced with the task of creating a counterfeit printing die, or with the task of tampering with a postage meter (franking machine) to force its printing die to be used to print postage indicia that are otherwise unaccounted-for. The latter approach is unsatisfactory because the design of the postage meter is such that tampering is easy to detect through visual examination of the meter.

In such a postage meter there are accounting registers which account for postage indicia that are to be printed or that have been printed. For example, in some countries there will be a "descending register" and an "ascending register". The former keeps track of the postage value that was paid for in advance, and when the descending register drops to some predetermined level the meter refuses to print any more postage. The latter keeps track of the total amount of postage that has ever been printed on the postage meter. The accounting registers and the printing mechanism are all within a single secure housing, and this provides a confidence level that if a postage indicium has been printed, it has been accounted for in the accounting registers. The communications between the accounting registers and the printing mechanism are secure communications because of the secure housing.

The die printing is done with fluorescent ink which provides yet another confidence level against counterfeit postal indicia.

In recent years it has been proposed by some postal authorities to print postal indicia by means of digital printing methods such as ink jet and thermal transfer, and by the use of commonly available inks and transferred pigments. With such a digital printing method the print area is typically bit-mapped, and the mail piece typically moves relative. to the print head. As the mail piece moves relative to the print head, a bit-mapped data stream is communicated to the print head and ink or transferred pigment are deposited on the mail piece in response to the bit-mapped data stream. With many such proposed systems there is no physically secure communications channel between the accounting registers and the printer.

Of course it will be appreciated that if a commonly available printer (and ink or pigment) is used, there is a substantial risk that some persons will be tempted to avoid having to pay for postage by the step of printing counterfeit postal indicia on mail pieces. This is particularly easy to do since the printed indicium could be scanned in a commonly available image scanner to arrive at a bit-mapped image that would, when printed, look quite like the original. Furthermore it will be recalled that in many such systems the communications channel between the accounting registers and the printer is, by definition, insecure. Thus the would-be counterfeiter can simply intercept the bit image of the postal indicium on its way from the accounting registers to the printer. This interception may be done in software (for example through the operating system) or in hardware (for example by capturing electrical signals passing through the Centronics-standard parallel printer cable).

The one measure that has been proposed to provide some level of protection against counterfeit postal indicia when commonly available printers are employed is the use of cryptographic authentication. The assumption is that there is a secure housing somewhere in the system, and within this housing are the accounting registers and also a cryptographic engine. The cryptographic engine is used, for example, to cryptographically "sign" the postal indicium. The post office may then examine the cryptographic signature on the mail piece and determine whether the indicium is authentic or counterfeit.

While the approach of the use of cryptographic signatures and commonly available printers is attractive from a theoretical point of view, there are practical drawbacks. It is easy enough to say that the indicium will include information that is to be examined by the post office, but on a practical level this will work only if the indicium, including the cryptographic signature, is machine-readable. It would be possible to use OCR (optical character recognition) characters that are optimized for scanning and recognition, or to use a bar code, for example a two-dimensional bar code. The US Postal Service has proposed the use of a two-dimensional bar code. The assumption is that nearly all mail pieces would be scanned and their indicia authenticated. This would require consistency checking for each indicium (e.g. that the cryptographic signature is consistent with the information that is "signed", such as the date and meter ID number). This would also require duplicate checking to ensure that a particular indicium has not been used more than once, since presumably the system is set up so that each indicium is supposed to be unique. The information proposed to be communicated by means of the two-dimensional bar code amounts to many hundreds of bits of data. The postal indicium thus would comprise a very large bar code as well as human-readable information that approximates a postal indicium of the type that is historically familiar.

Those with experience with postage meters will readily appreciate that a postal indicium which contains the images of a historically familiar indicium and that also contains a two-dimensional bar code of several hundred bits is quite sizeable and, importantly, is at risk of being smudged or otherwise damaged. If an inkjet printer is used, there is the concern that the indicium would be touched or smudged before the ink has dried. There is the further concern that if the indicium gets wet (for example, if the envelope is exposed to rain or other moisture) then the ink may smudge. In the case of a thermal transfer image, there is the concern that the thermally transferred pigment may be removed by abrasion or other perils. There is also the concern that the mail piece may not be perfectly constant in thickness, for example, if the envelope contents do not completely fill the envelope or if there is a staple or paper clip in the area where the indicium will be printed. These factors all work against the possibility that the two-dimensional bar code can be successfully read by the post office for reason of authentication.

Even if none of these perils occurs—no moisture, no smudging, no abrasion, no paper clip or staple—there is still the problem that the two-dimensional bar code must be printed faithfully in the first place. The horizontal and vertical spacing of the pixels that make up the bar code is required to be maintained accurately. This requirement applies to each pixel individually and there is the related requirement that the pixels be consistent in size across the vertical and horizontal extent of the bar code.

As will be appreciated, it would be very convenient if the designer of the digital printing franking machine were able to assume that the mail piece were always moving at an exact and very predictable velocity relative to the print head. In such a case, the data stream communicated to the print head could be clocked at a particular fixed rate, yielding an image in which everything is controlled and the image has all desired qualities.

As a general matter, however, the designer of the digital postage flanking machine is not able to assume that the mail piece is always moving at an exact and very predictable velocity relative to the print head. There can be variations of speed for mail pieces in the paper path depending on the number and types of mail pieces and their sizes. Many factors can contribute to the variations, such as the thickness of particular mail pieces and changes in the total mass of mail pieces that are within the paper path at a particular moment. A variation of speed over a relatively long interval relative to a desired speed can give rise to a postal indicium that is squeezed or stretched in its entirety in the axis parallel to the direction of motion of the mail piece. In such a case a printed pattern that is intended to form a circle would instead form an ellipse. On the other hand, variations of speed over relatively short intervals can give rise to a postal indicium that is irregular in its pixel dimension along the direction of motion. Any of these distortions of the bar code risks making the bar code unreadable for authentication purposes.

A commonly used approach for measuring the velocity of a mail piece is to place a roller in friction contact with the mail piece. The roller is coupled with a resolver or other sensor, and the resolver output is used to clock the print bit-map into the print head. This approach is not completely satisfactory, however. The roller may slip relative to the mail piece. The roller and the other moving, parts coupled to it present a rotational inertia which make it difficult for the roller to keep up with sudden changes in the velocity of the mail piece. The roller is also a maintenance item and the pressure with which it is biased toward the mail piece may need to be adjusted from time to time.

It is desirable to have a reliable way of measuring the velocity of a mail piece that is sufficiently accurate, lacks the drawbacks of the roller approach, and is not too expensive.

SUMMARY OF THE INVENTION

A postage meter (franking machine) uses a digital print head such as an ink-jet or thermal transfer or dot-matrix print head, for which it is necessary to know the velocity of the mail piece passing by the print head. Two collimated monochromatic beams strike the mail piece, one at an angle leading the mail piece velocity and the other at an angle lagging the mail piece velocity. The beams converge yielding a sensing region filled with a diffraction pattern. The mail piece, assumed to be rough at a scale that is appropriate for the velocity measurement, moves at some velocity. A detector detects light intensity (photon flux) at a small region within the sensing region, and the intensity signal has a frequency that is proportional to the mail piece velocity. The frequency is detected or measured, the instantaneous velocity is derived therefrom, and the velocity is used to control the print head. In this way a two-dimensional print image (postage indicium) is faithfully printed on the mail piece with minimal distortion even in the event of non-constant velocity of the mail piece.

DETAILED DESCRIPTION

Figure 1:
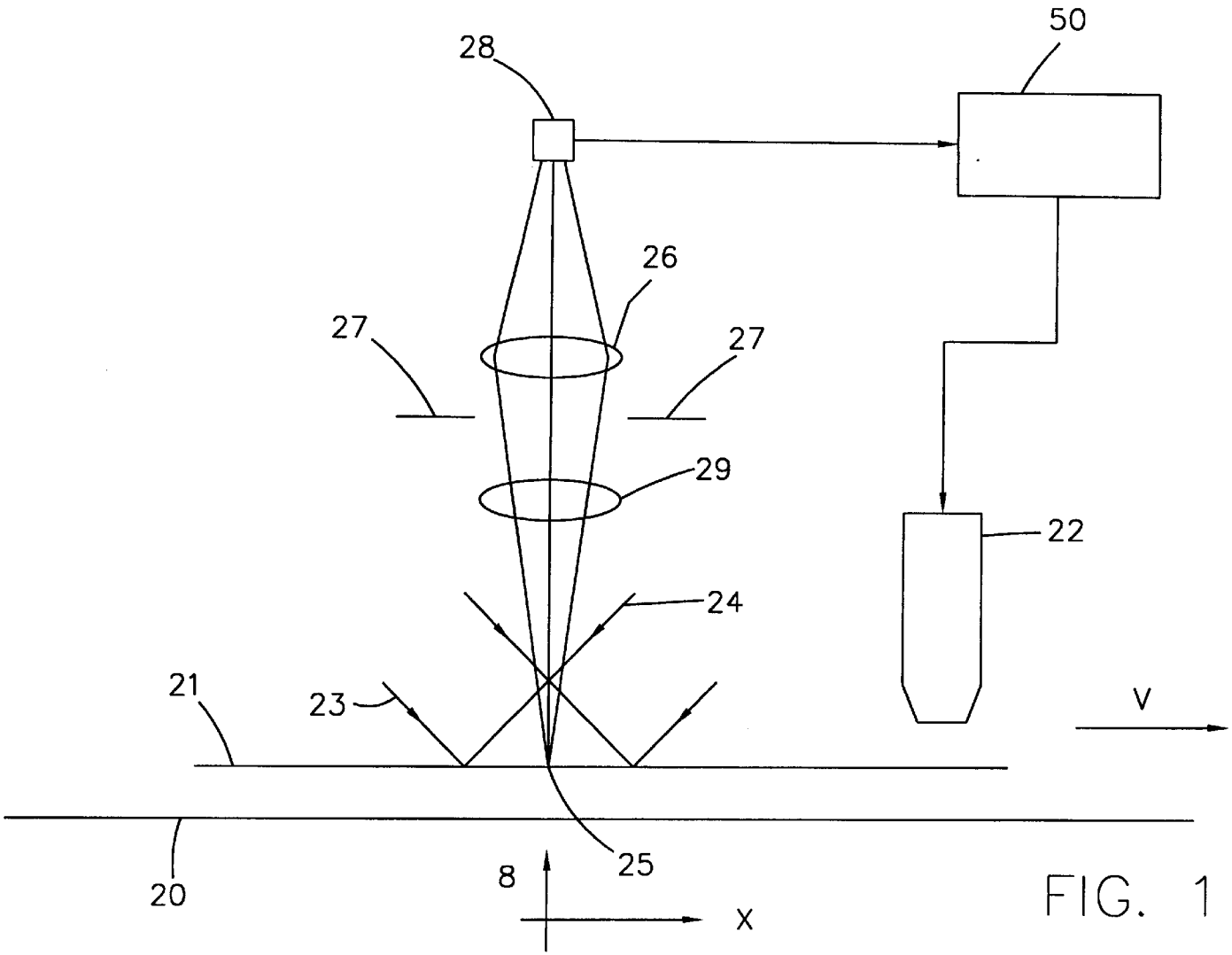
FIG. 1 shows in cross section a system according to the invention.

FIG. 1 shows a system according, to the invention. A mail piece 21 moves rightward in FIG. 1 at a velocity v along, a defined axis x along, a paper path defined by a bed 20. The velocity v may vary from time to time due to many factors. Perpendicular to bed 20 is a z axis. A print head 22 is positioned to be able to print on the mail piece 21. The print head 22 is any print mechanism that benefits from careful measurement of the position and velocity of the mail piece 21, and thus might be inkjet, thermal transfer, or other digitally imaged printing technology. The mail piece is not perfectly smooth but instead has some roughness when viewed on a sufficiently small scale.

The mail piece 21 is struck by light from two directions, as shown by rays 23 and rays 24. Rays 23 approach the mail piece from behind, that is, the mail piece is moving away from the rays 23. Rays 24 approach the mail piece from the front, that is, the mail piece is moving toward the rays 24. The rays 23 and 24 are preferably monochromatic and are mutually coherent and each collimated. Rays 23 and 24 create an interference pattern on the mail piece 21.

FIG. 1 also shows a sensor 28 and a focusing lens 26. Light is able to pass from a sensing area 25 on the mail piece through the lens 26, confined by mask 27 to an optical opening sized appropriately for the lens 26. Light rays 29 show light passing from the sensing area 25 to the sensor 28. Signal processing circuitry 50, discussed in detail below, receives the signal from the sensor 28 and derives velocity information which is used to clock image information into the print head 22. In this way, the print head 22 is able to print a properly formed image on the mail piece 21. Sensor 28 is a photodetector such as a phototransistor. In an exemplary embodiment the sensor is not a spatial or linear array but simply measures light intensity (proportional to photon flux).

Figure 2:
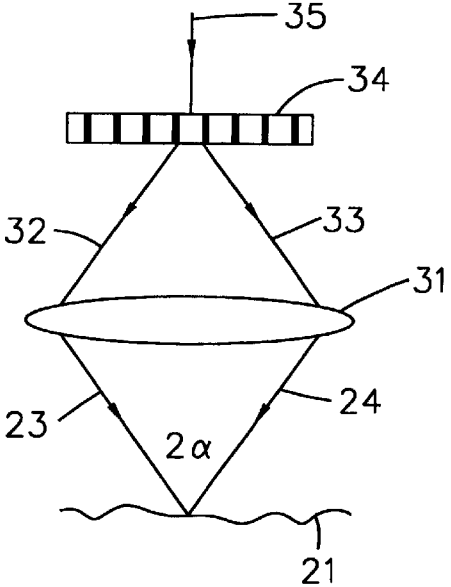
FIG. 2 shows a light source for the system according to the invention.

FIG. 2 shows a light source suitable for use in the system according to the invention. Mail piece 21 is shown with a rough surface (at an appropriate scale). A narrow beam 35 is preferably monochromatic and collimated, for example emitted from a laser diode omitted for clarity from FIG. 2. The beam 35 passes through a an optical element 34 which gives rise to distinct beams 32 and 33. Optical element 34 may be a phase grating. More generally the optical element 34 is any diffraction optical element (DOE). A DOE is an inexpensive optical component which works by diffraction from microstructures. DOEs are fabricated either interferometrically, or by direct writing or with the help of lithographic and etching methods derived from microelectronic technology.

The distinct beams 32, 33 are refracted by lens 31 yielding beams 23, 24 shown also in FIG. 1 along with mail piece 21. The two means 23, 24 strike the mail piece 21 defining an angle $2\alpha$.

Figure 3:
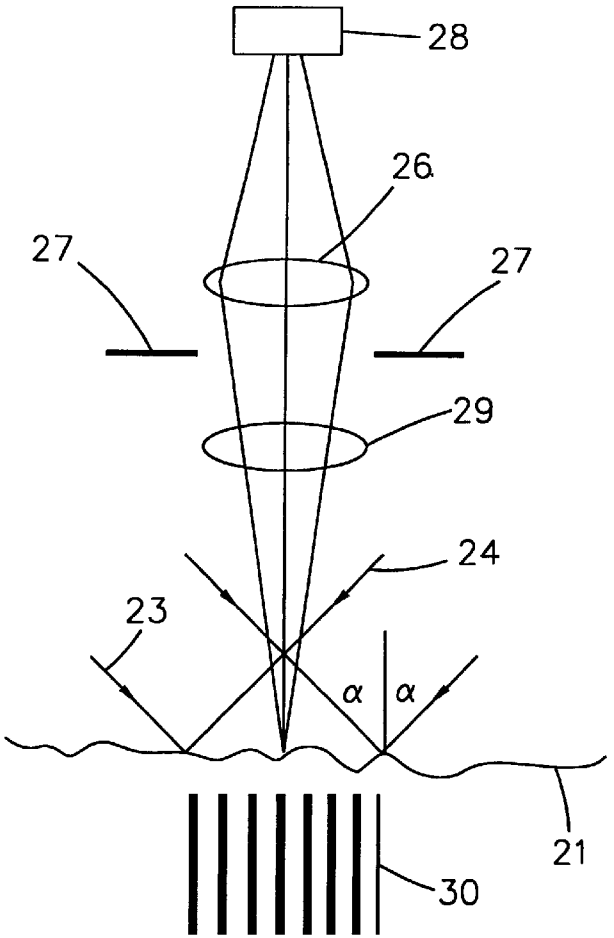
FIG. 3 shows a detection optical path for the system according to the invention.

FIG. 3 shows the mail piece 21 at a close scale with illustrative roughness. The beams 23, 24 strike the surface with angle $2\alpha$ between them. The beams generate a diffraction pattern 30 shown in FIG. 3. Light rays 29 from a sensing region on the mail piece 21 pass upward in FIG. 3, pass through an opening defined by mask 27, and are refracted by lens 26 to be focused on sensor 28.

Figure 4C:
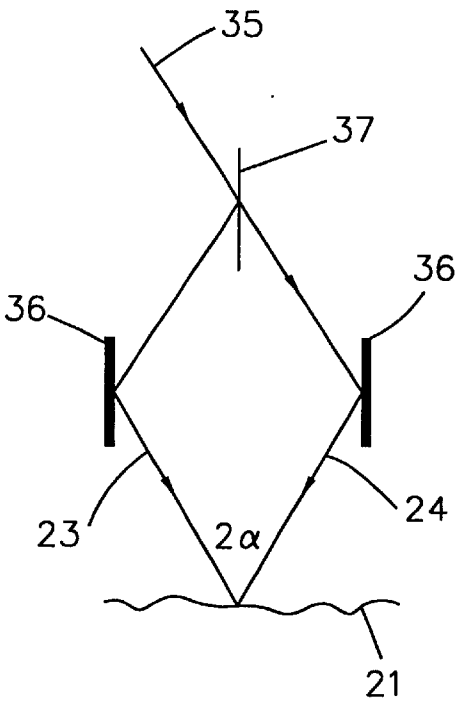
FIGS. 4*a*,4*b*, and 4*c* show alternative light sources for the system according to the invention.
Figure 4B:
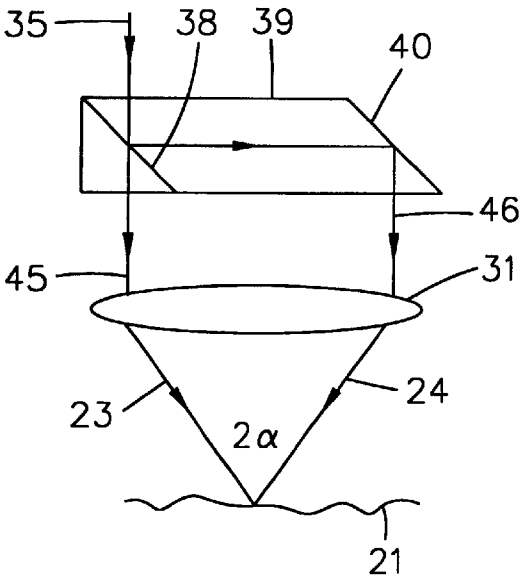
Figure 4A:
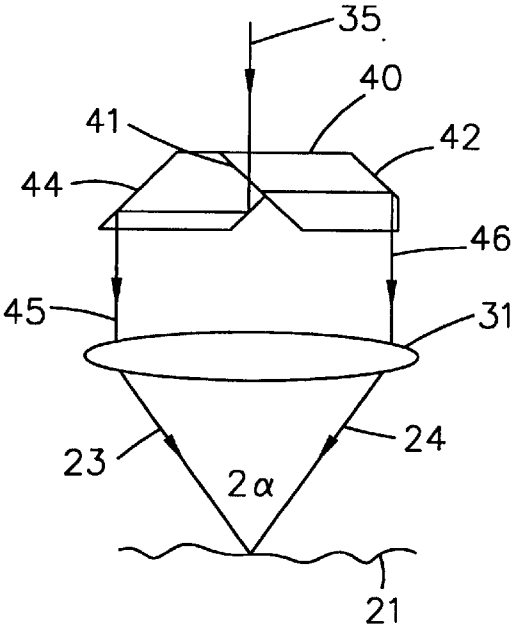

There are other ways to create the mutually coherent collimated beams 23, 24 in addition to the optical structure shown in FIG. 2. For example, in FIG. 4*a,* a beam 35 strikes a prism 40 and reaches a partially reflective surface 41, thereby splitting the beam 35. One resulting beam 45 is reflected from mirrors 43 and 44. The other resulting beam 46 is reflected from mirror 42. The beams 45, 46 are refracted by lens 31 to yield beams 23, 24 which strike mail piece 21 and define an intersection angle $2\alpha$. In FIG. 4*b,* a beam 35 strikes a partially reflective surface 38 within prism 39 yielding two beams. Beam 45 is transmitted through surface 38. Beam 46 is reflected from surface 38 and from mirror 40. Beams 45 and 46 are refracted by lens 31 yield beams 23, 24 which strike mail piece 21 and define an intersection angle $2\alpha$. In still another arrangement, beam 35 strikes partially reflective surface 37, yielding beams 23, 24 which are reflected from mirrors 36. They strike mail piece 21 and define an intersection angle $2\alpha$. The arrangements of FIGS. 4*a,* 4*b,* and 4*c* are thought less desirable than that of FIG. 2, because for best results the two beams should be highly symmetric. Preserving such symmetry requires that the mirrors be accurately positioned with tight tolerances. The partially silvered beam splitting surface must likewise be coated in such a way as to provide equal light intensity in both beams, to maximize the fringe (interference pattern) contrast.

Figure 5:
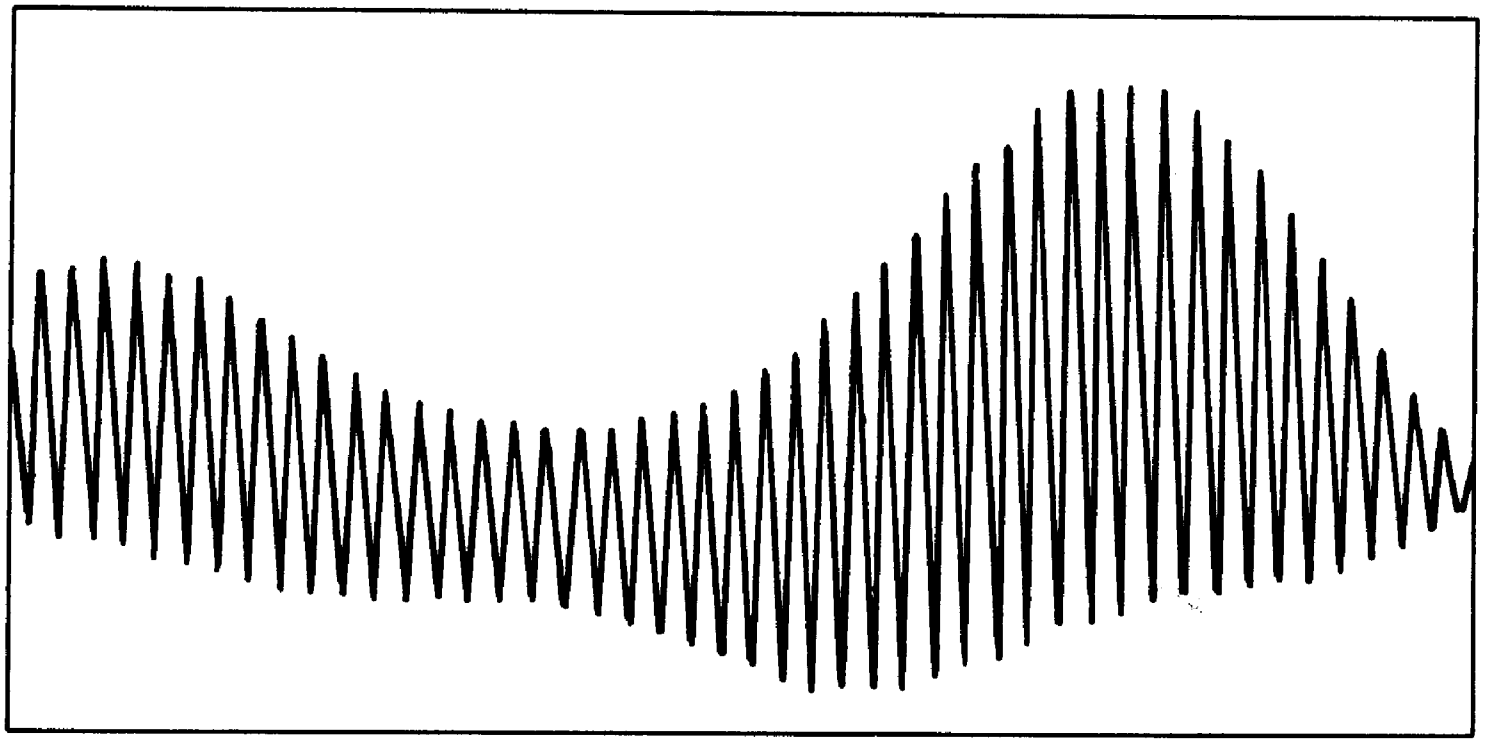
FIG. 5 shows a typical detected signal with a varying envelope.

A typical output signal from sensor 28 is shown in FIG. 5. The frequency of the signal within the envelope is proportional to the instantaneous velocity. The modulation depth of the envelope varies from burst to burst and the signal may not be present at all times, that is, it may drop out. It is helpful to define a dropout rate which is the ratio between the times during which no signal is processed and the total time of the signal.

Recall from FIG. 1 that signal processing circuitry 50 is provided to process the signal (for example, that shown in FIG. 5) to derive velocity information. Workable signal processing methods include burst counting, frequency tracking and fast Fourier transform (FFT) analysis.

Figure 6:
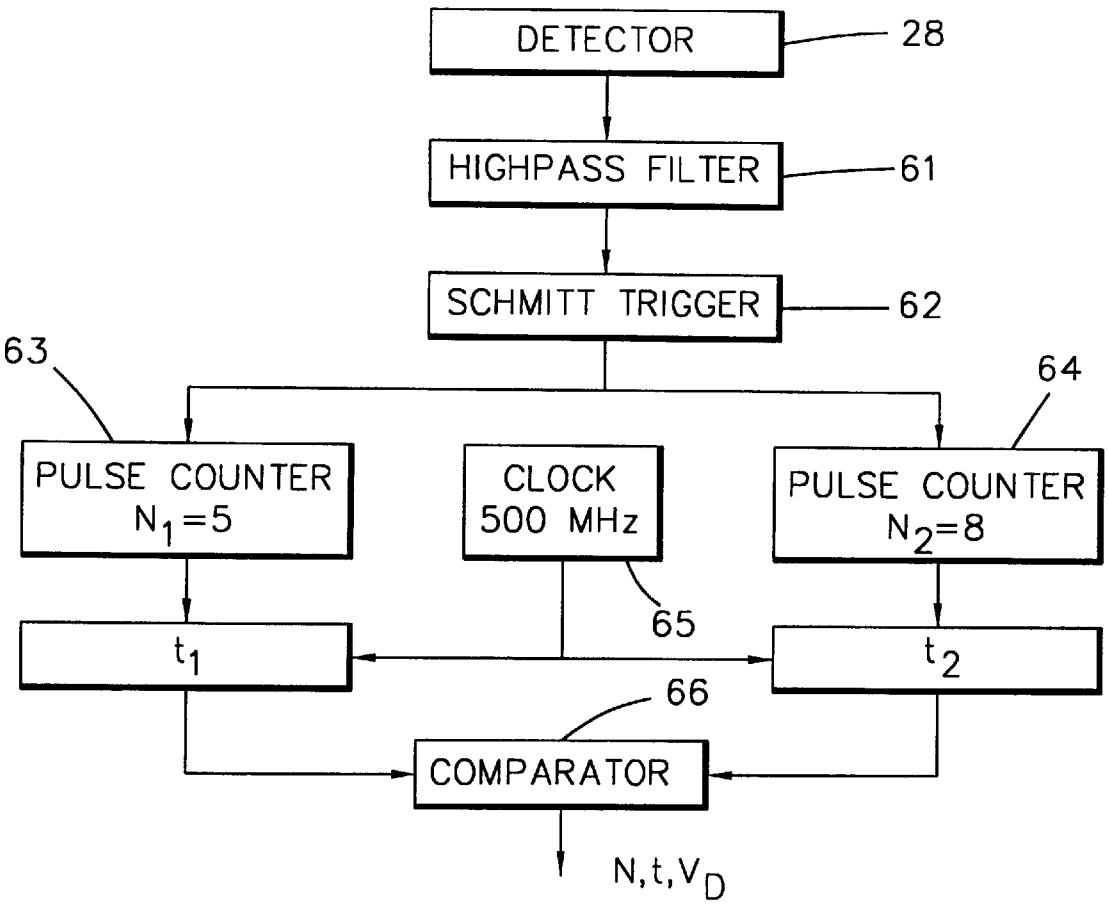
FIG. 6 shows an exemplary signal processing circuit for the detected signal.

One way to do burst counting is to preferably high-pass-filter the signal from the sensor 28, as shown in one embodiment in FIG. 6, and pass the signal through a Schmitt trigger 62. It may optionally be mixed with a local oscillator to provide a convenient working frequency. Then a fixed gate time is preset and the number of zero crossings in this interval is counted and the frequency calculated. Alternatively, as shown in FIG. 6, the time taken for a fixed number of zero crossings is measured as in boxes 63, 64.

Many sources of error exist and they must be provided for to the extent possible. For example, the zero crossings may be separated by unequal time intervals. Spurious zero crossings may occur due to noise, although hopefully the Schmitt trigger and other measures will reduce this. Some zero crossings may be missing due to poor signal-to-noise ratio. For these reasons, various electronic schemes have been developed to reject incorrect bursts, for example by making. Comparison between $N_1$=5 and $N_2$=8 cycles, as shown in FIG. 6 in boxes 63 and 64 respectively.

A burst counter requires a higher signal-to-noise ratio than some other signal processing techniques. But the burst counter approach does not require a continuous signal and can function well even with high dropout values.

Figure 7:
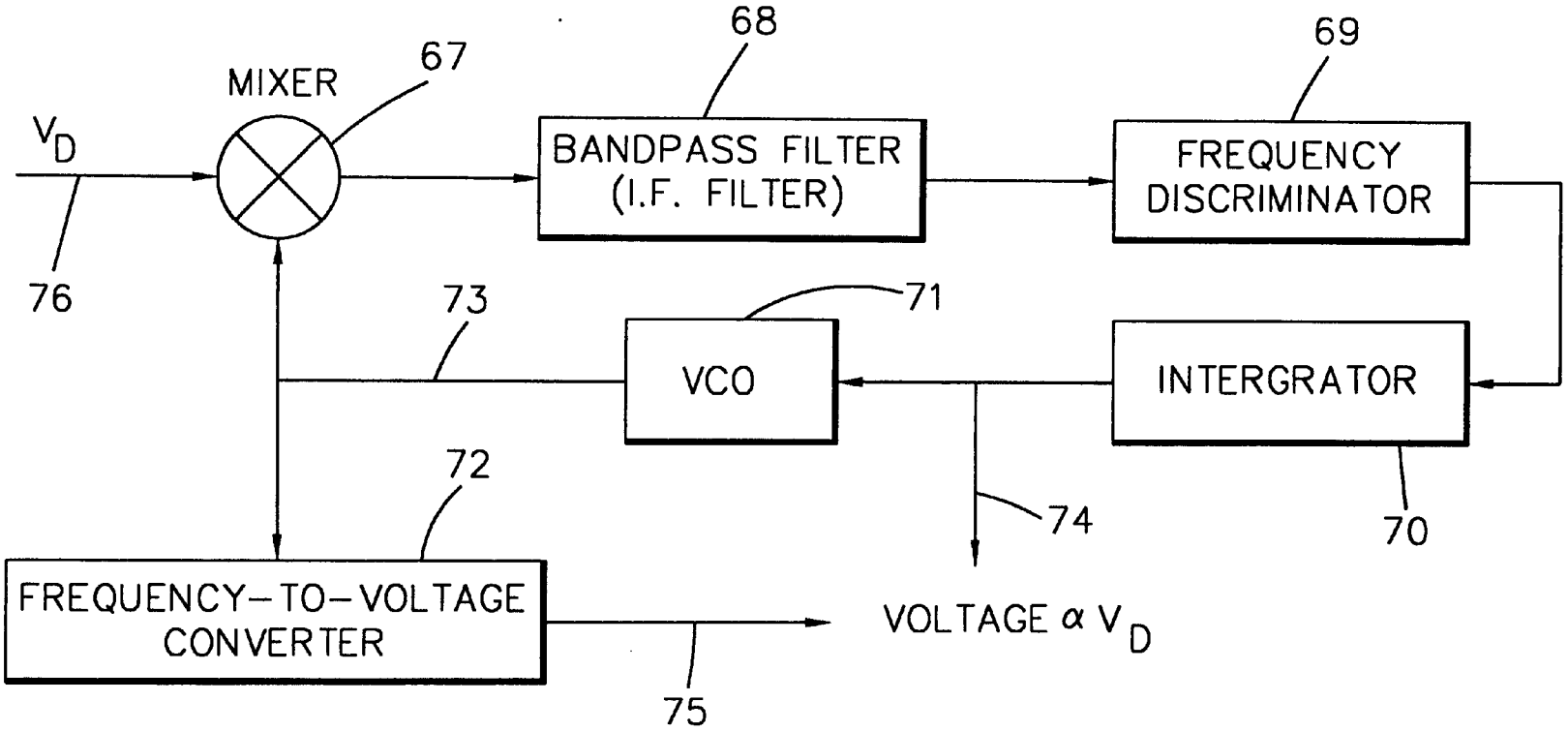
FIG. 7 shows an alternative signal processing circuit for the detected signal.

Another approach is the frequency tracker of FIG. 7. The analog, output from the detector 28 (omitted for clarity in FIG. 7) is mixed at 67 with a sinusoidal signal from a voltage-controlled oscillator (VCO) 71 which is in a feedback loop. The mixed signal is passed through a narrow bandpass filter 68 and a frequency discriminator 69. This signal is integrated at 70 and the output controls the VCO 71. The integrator 70 regulates the transient response and the stability of the feedback loop. The VCO frequency (at line 73) thus tracks the frequency of the incoming analog signal (at line 76) from the detector 28. The input signal (at line 74) of the VCO 71 is proportional to the instantaneous input frequency.

As shown in FIG. 7, a frequency-to-voltage convertor 72 may optionally be used to derive a voltage (at line 75) proportional to the input frequency. This gives better linearity than monitoring the signal at 74.

The chief disadvantage of the approach shown in FIG. 7 is that it requires a near-continuous input signal at 76. In the case where the input signal at 76 is not continuous, a lock-on lock-off mechanism must be provided to hold the last known measured frequency until a new signal arrives.

Figure 8:
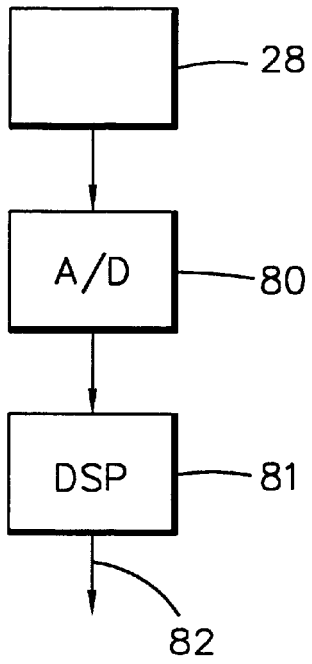
FIG. 8 shows another alternative signal processing circuit for the detected signal.

Still another approach is the performance of a fast Fourier transform (FFT) in real time using digital signal processing (DSP) technology. In a typical embodiment, the raw signal from the detector 28 (see FIG. 8) is passed to an analog-to-digital (A/D) converter 80. The digital signal is passed to a DSP 81. The DSP FFT approach is quite effective at discriminating the velocity signal from background noise.

There are several choices for the positioning of the velocity sensing optics (FIG. 1, items 28, 26, and the light sources yielding rays 23, 24 in FIG. 1) relative to the print head 22 (FIG. 1). For simplicity of portrayal the optics in FIG. 1 are shown upstream of the print head 22. But nothing in the invention requires this relative positioning. For example, it may prove desirable that the optics be positioned neither upstream nor downstream but instead in the Y axis in FIG. 1 relative to the print head 22. It might also prove desirable to position the optics on the opposite side of the mail piece from the print head, optionally opposed to the print head 22.

The underlying optics theory will now be described. One way to describe the measurement technique is to define a displacement of the mail piece in the x-direction $u_x$ which results in an optical phase difference between the two interfering beams given by:

$$\Delta\varphi = \frac{4\pi\sin\alpha}{\lambda}u_x = \frac{4\pi\sin\alpha}{\lambda}vt$$

In this equation the displacement $u_x$ is related to the mail piece velocity by $u_x$=vt. From this equation, the frequency of the interference signal is expressed by $$v = \frac{1}{2\pi}\frac{d}{dt}(\Delta\varphi) = \frac{2\sin\alpha}{\lambda}v$$

Another way of describing the velocity measurement is in terms of the classical Doppler effect. In FIG. 1 the beam 24 is scattered with a positive Doppler frequency shift, while the beam 23 suffers a frequency reduction after scattering. Therefore, the light scattered from the rough surface experiences an intensity modulation with a frequency $v_D$ proportional to the speed of the surface v in the x-direction, namely:

$$v_D = \frac{2\sin\alpha}{\lambda}v$$

It should be appreciated that v sin α is the projection of the velocity v in the direction of either of the laser beams. The frequency detected in this way does not depend on the direction of the observation (or detection). This is a great advantage for the design of the sensor head.

Figure 9:
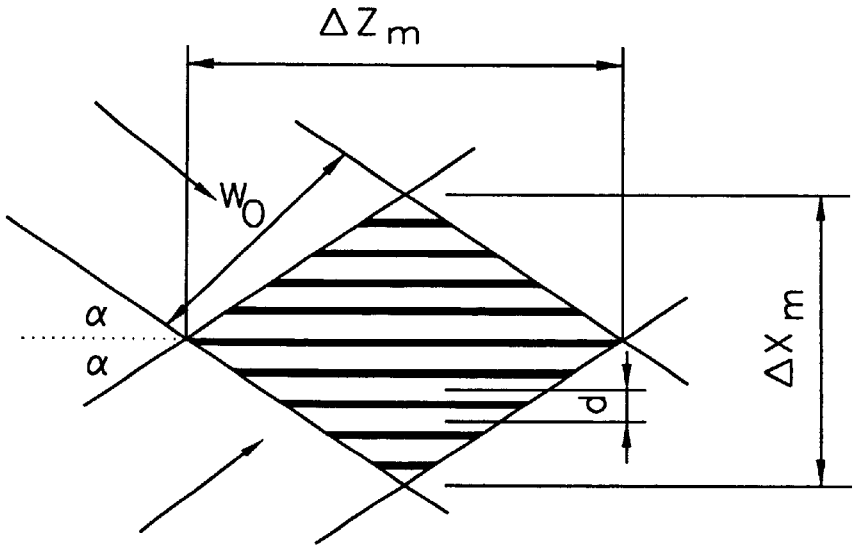
FIG. 9 shows the sensing volume for the system according to the invention.

It is beneficial to have a probe volume filled with fringes that are separated by exactly the same distance d as shown in FIG. 9. Variations in the spatial period d will lead to errors in the measured mail piece velocity. Such a problem may occur if the two beams do not cross and strike at the same point, resulting in a fringe divergence.

Assuming two identical beams 23, 24 illuminating the rough surface, it is possible to define the sensed region (probe volume) with dimensions $\Delta x_m$, $\Delta y_m$ and $\Delta z_m$ given by $$\Delta x_m = \frac{2w_0}{\cos\alpha}$$

$$\Delta y_m = 2w_0$$

$$\Delta z_m = \frac{2w_0}{\sin\alpha}$$

where 2α is, as before, the mutual angle of the illuminating directions (FIG. 2) and $w_0$ is the beam width (radius). It should be mentioned that $\Delta z_m$ corresponds approximately to the depth of field of the measurement system. Stated differently, the magnitude of $\Delta z_m$ gives an approximate indication of the extent to which a mail piece might be slightly higher or lower relative to the bed 20 and still have a successful velocity measurement.

The number of interference fringes in the probe volume is approximately $$N_f = \frac{\Delta x_m}{d} = \frac{4w_0}{\lambda}\tan\alpha$$

In an exemplary arrangement the beam width might be $w_0$=2 mm, the wavelength might be λ=780 nm. For α=45 degrees, the probe volume dimensions are about $\Delta x_m$=5 mm, $\Delta y_m$=2 mm, and $\Delta z_m$=5 mm and the number of fringes is about ten thousand.

Using the optics and related circuitry described herein, the measuring accuracy is dependent solely on the wavelength of light used and the angle (2α) at which the beams strike the mail piece. The measurement accuracy is not sensitive to vibrations or dust or variations of temperature or humidity. The motion sensor head can be compact. The optical system is quite simple—a lens, a photodiode or phototransistor, a light-emitting diode, and a diffraction grating or other diffraction optical element. The measurement is non-contact which is advantageous.

What is claimed is:

1. A postage meter comprising a digital print head and a velocity sensor having an output, said postage meter having a bed defining a paper path with a direction, said digital print head and said velocity sensor positioned along said paper path; said velocity sensor comprising a light source and a light sensor, said light source comprising first and second monochromatic collimated beams, said first beam impinging upon said paper path at a first angle leading said direction and defining a sensing area, said second beam impinging upon said sensing area at said first angle lagging said direction, said first and second beams yielding a diffraction pattern within said sensing area; said light sensor sensing light intensity at a region within said sensing area, said velocity sensor further comprising a frequency detector responsive to said sensed light intensity yielding a signal indicative of the measured frequency, said signal comprising the output of the velocity sensor; said print head operatively coupled with said velocity sensor output.

2. The postage meter of claim 1 wherein the light source further comprises a diffraction optical element, a convex lens, and a laser diode, light emitted by said laser diode passing through said diffraction optical element and being split thereby into two divergent beams, said two divergent beams passing through said lens and being refracted thereby to converge in the sensing area.

3. The postage meter of claim 1 wherein the light sensor comprises a concave lens focusing light from the region within the sensing area onto a photodiode or phototransistor.

4. The postage meter of claim 1 wherein the sensing area, is positioned neither upstream nor downstream relative to the print head with respect to the direction.

5. The postage meter of claim 1 wherein the sensing area is positioned on the opposite side of a mail piece from the print head.

6. The postage meter of claim 5 wherein the sensing area is positioned neither upstream nor downstream relative to the print head with respect to the direction.

7. The postage meter of claim 6 wherein the sensing area is opposed to the print head.

8. The postage meter according to claim 1 wherein a mail piece is positioned on the bed defining the paper path and moves in the direction, and wherein when the moving mail piece reaches the sensing area the first beam impinges upon the mail piece at the first angle leading the direction.

9. The postage meter of claim 1, wherein a mail piece is positioned on the bed defining the paper path and moves at a velocity, and wherein the velocity sensor is adapted to determine the velocity of the mail piece for triggering a printing of a postal indicium on the mail piece in a predetermined location.

10. The postage meter of claim 9 wherein the velocity of the mail piece is variable with respect to a velocity of the bed defining the paper path.

11. The postage meter of claim 1 wherein a mail piece is positioned on the bed defining the paper path, the mail piece having a non-smooth surface and wherein the output of the velocity sensor is a velocity of the mail piece.

12. The postage meter of claim 1 wherein the velocity sensor measures a velocity of a mail piece on the bed defining the paper path irrespective of a velocity of the bed defining the paper path.

13. The postage meter of claim 1 wherein the sensing area is positioned in a Y-axis relative to the print head.

14. The postage meter of claim 1 wherein a mail piece is positioned on the bed defining the paper path, the mailpiece having a non-constant thickness.

15. A method for printing a postage indicium on a mail piece moving with a velocity in a direction, said method comprising the steps of:

causing first and second monochromatic collimated beams to impinge upon said mail piece, said first beam impinging upon said mail piece at a first angle leading said direction and defining a sensing area, said second beam impinging upon said sensing area at said first angle lagging said direction, said first and second beams yielding a diffraction pattern within said sensing area;

sensing a light intensity at a region within said sensing area, measuring, the frequency of the light intensity; and operating a print head in response to the measured frequency to print a postage indicium upon the mail piece.

16. The method of claim 15 further comprising creating said first and second beam by passing, light through a diffraction optical element yielding two divergent beams, and passing the two divergent beams through a convex lens.

17. The method of claim 15 wherein the mail piece is located on a moving bed defining a paper path.

18. The method of claim 15 wherein the mail piece has a non-smooth surface.

19. The method of claim 15 wherein the mail piece is moving with a velocity irrespective of a velocity of a moving bed defining a paper path on which the mail piece is located.

20. The method of claim 15 further comprising the steps of:

maintaining a constant velocity for a bed defining a paper path on which the mail piece is moving; and adjusting a timing for printing the postage indicium on the mail piece based on the velocity of the mail piece as determined by the measured frequency.

* * * * *